US007182206B2

(12) United States Patent
Hukki et al.

(10) Patent No.: US 7,182,206 B2
(45) Date of Patent: Feb. 27, 2007

(54) SCREEN ENERGIZER

(75) Inventors: Ari M. Hukki, Edgewood, KY (US); Peter D. Knox, Union, KY (US)

(73) Assignee: M-I L.L.C., Houston, TX (US)

( * ) Notice: Subject to any disclaimer, the term of this patent is extended or adjusted under 35 U.S.C. 154(b) by 252 days.

(21) Appl. No.: 10/427,695

(22) Filed: May 1, 2003

(65) Prior Publication Data

US 2003/0213731 A1 Nov. 20, 2003

Related U.S. Application Data

(60) Provisional application No. 60/377,701, filed on May 3, 2002.

(51) Int. Cl.
*B07B 1/42* (2006.01)

(52) U.S. Cl. ..... 209/365.1; 209/379

(58) Field of Classification Search ..... 209/359, 209/360, 364, 365.1, 365.4, 405, 411, 366, 209/366.5, 379, 380, 381; 366/108, 124; 310/81

See application file for complete search history.

(56) References Cited

U.S. PATENT DOCUMENTS

| | | | | |
|---|---|---|---|---|
| 2,880,871 A | | 4/1959 | Brüninghaus | 209/310 |
| 3,035,700 A | * | 5/1962 | McCausland | 209/405 |
| 3,330,411 A | * | 7/1967 | Gunter et al. | 209/257 |
| 3,444,999 A | * | 5/1969 | Hurst | 209/316 |
| 3,483,977 A | * | 12/1969 | Westfall et al. | 209/403 |
| 3,490,584 A | * | 1/1970 | Lewis | 209/1 |
| 3,954,604 A | * | 5/1976 | Krause et al. | 209/325 |
| 4,152,255 A | | 5/1979 | Musschoot | 209/234 |
| 4,274,953 A | | 6/1981 | Jackson | 209/326 |
| 4,482,455 A | | 11/1984 | Humphrey | 209/319 |
| 4,816,144 A | | 3/1989 | Monteith | 209/364 |
| 5,143,222 A | | 9/1992 | Monteith | 209/364 |
| 5,213,216 A | * | 5/1993 | Suehiro et al. | 209/236 |
| 5,398,816 A | | 3/1995 | Senapati | 209/364 |
| 5,456,365 A | | 10/1995 | Janssens et al. | 209/403 |
| 5,542,548 A | | 8/1996 | Senapati | 209/365.1 |
| 5,653,346 A | | 8/1997 | Frei et al. | 209/254 |
| 5,799,799 A | * | 9/1998 | Alamzad et al. | 209/365.1 |
| 5,915,566 A | | 6/1999 | Senapati | 209/365.1 |
| 6,698,593 B1 | * | 3/2004 | Folke et al. | 209/404 |

FOREIGN PATENT DOCUMENTS

| | | |
|---|---|---|
| GB | 1 462 866 | 1/1977 |

* cited by examiner

*Primary Examiner*—Joseph Rodriguez
(74) *Attorney, Agent, or Firm*—Connolly Bove Lodge & Hutz

(57) ABSTRACT

A screening system including a vibratory screen separator having a resiliently mounted frame with a low frequency vibratory drive coupled to that frame. A taut screen is rigidly mounted in the frame and a vibration transmitter assembly is resiliently mounted to the frame and fixed to the taut screen. The vibration transmitter includes a planar ring compressed against the taut screen and vibration generators. The vibration generators are air turbines with eccentric weights. The frame includes support elements extending from the cylindrical outer housing sections of the separator to a concentrically mounted support ring. Compressed air is provided to the turbines through hollow structure within the frame. Valves control exhaust from the turbines. The low frequency vibratory drive operates in a range of about 8 Hz to 30 Hz while the vibration generators provided by the air turbines operate in a range of about 275 Hz to 600 Hz.

62 Claims, 5 Drawing Sheets

SCREEN ENERGIZER

REFERENCE TO RELATED APPLICATIONS

This application claims priority to U.S. Provisional Patent Application S. N. 60/377,701, filed May 3, 2002, the disclosure of which is incorporated herein by reference.

BACKGROUND OF THE INVENTION

The field of the present invention is fine mesh screening systems including the use of vibration to assist screening.

Traditional vibratory screening systems typically include a base, a frame resiliently mounted to the base with a screen or screens extending across the frame. A low frequency vibratory drive in the speed range of 8 Hz to 30 Hz with eccentric weights is mounted to the frame. Specific vibratory motions are established in the frame by the low frequency vibratory drive depending upon the phase of the eccentric weights, generating screen accelerations up to the 7 g range. One such vibratory screen separator is illustrated in U.S. Pat. No. 5,456,365, the disclosure of which is incorporated herein by reference.

The foregoing devices have been used for screening a wide variety of materials in size and shape. Further, such devices handle a variety of flow conditions for material to be screened from dry to fully entrained in liquid.

A number of circumstances and conditions can reduce screening efficiency with such devices. For example, screens can be blinded by certain materials which are not dislodged by the vibratory action. Another problem can be that finer materials float above the low frequency vibrating screen.

In an effort to overcome certain of the deficiencies of low frequency vibration, ultrasonic vibrators have been employed in conjunction with low frequency vibratory drives. Ultrasonic vibrators have been mounted to separator frames with a direct mechanical attachment to the screens at the centers thereof. Reference is made to U.S. Pat. No. 5,653,346. Alternatively, ultrasonic drives have been supported directly by the screen. Reference is made to U.S. Pat. No. 5,143,222. Additionally, ultrasonic vibrators have been mounted to the peripheral frame of the screen. Reference is made to U.S. Pat. No. 5,398,816, the disclosure of which is incorporated herein by reference.

SUMMARY OF THE INVENTION

The present invention is directed to vibrator assemblies and screening systems employing such assemblies.

In a first separate aspect of the present invention, a taut screen is rigidly mounted to a resiliently mounted frame having a low frequency vibratory drive coupled to the frame. A vibration transmission assembly resiliently mounted to the frame includes a transmitter and at least one vibration generator fixed to the transmitter. The vibration generator is operable in a subsonic frequency range to generate multiple cycles of amplitude in the taut screen at a time.

In a second separate aspect of the present invention, a taut screen is rigidly mounted to a resiliently mounted frame having a low frequency vibratory drive coupled to the frame. A vibration transmission assembly resiliently mounted to the frame includes a transmitter and at least one vibration generator fixed to the transmitter. The transmitter is rigid so as to vibrate with the one or more vibration generators as a rigid body. The one or more vibration generators may be employed in a vibration range of about 275 Hz to 600 Hz.

In a third separate aspect of the present invention, a taut screen is rigidly mounted to a resiliently mounted frame having a low frequency vibratory drive coupled to the frame. A vibration transmission assembly includes at least one vibration generator rigidly coupled to the taut screen. Each of the at least one vibration generator is fluid driven.

In a fourth separate aspect of the present invention, the fluid driven vibration generators of the third separate aspect may be air turbines with eccentric weights. Such turbines may be controlled by restricting exhaust flow. Further, the vibration transmission assembly may include a transmitter resiliently mounted to the frame.

In a fifth separate aspect of the present invention, a taut screen is rigidly mounted to a resiliently mounted frame having a low frequency vibratory drive coupled to the frame. A vibration transmission assembly resiliently mounted to the frame includes a transmitter and at least one vibration generator fixed to the transmitter. The low frequency vibratory drive is operable in a range to generate substantially a single cycle of amplitude in the frame at a time while the vibration transmitter assembly is operable in a subsonic frequency range generating multiple samples of amplitude in the taut screen at a time.

In a sixth separate aspect of the present invention, a vibrator assembly for a screen includes a housing section having a mounting for the screen, a support ring within the housing and support elements extending between the housing and the support ring. A vibration transmitter assembly includes a transmitter and a vibration generator. The transmitter vibrates with the vibration generator or generators as a rigid body.

In a seventh separate aspect of the present invention, any of the foregoing separate aspects are contemplated to be employed in combination to advantageous effect.

DETAILED DESCRIPTION OF THE PREFERRED EMBODIMENTS

Figure 1:
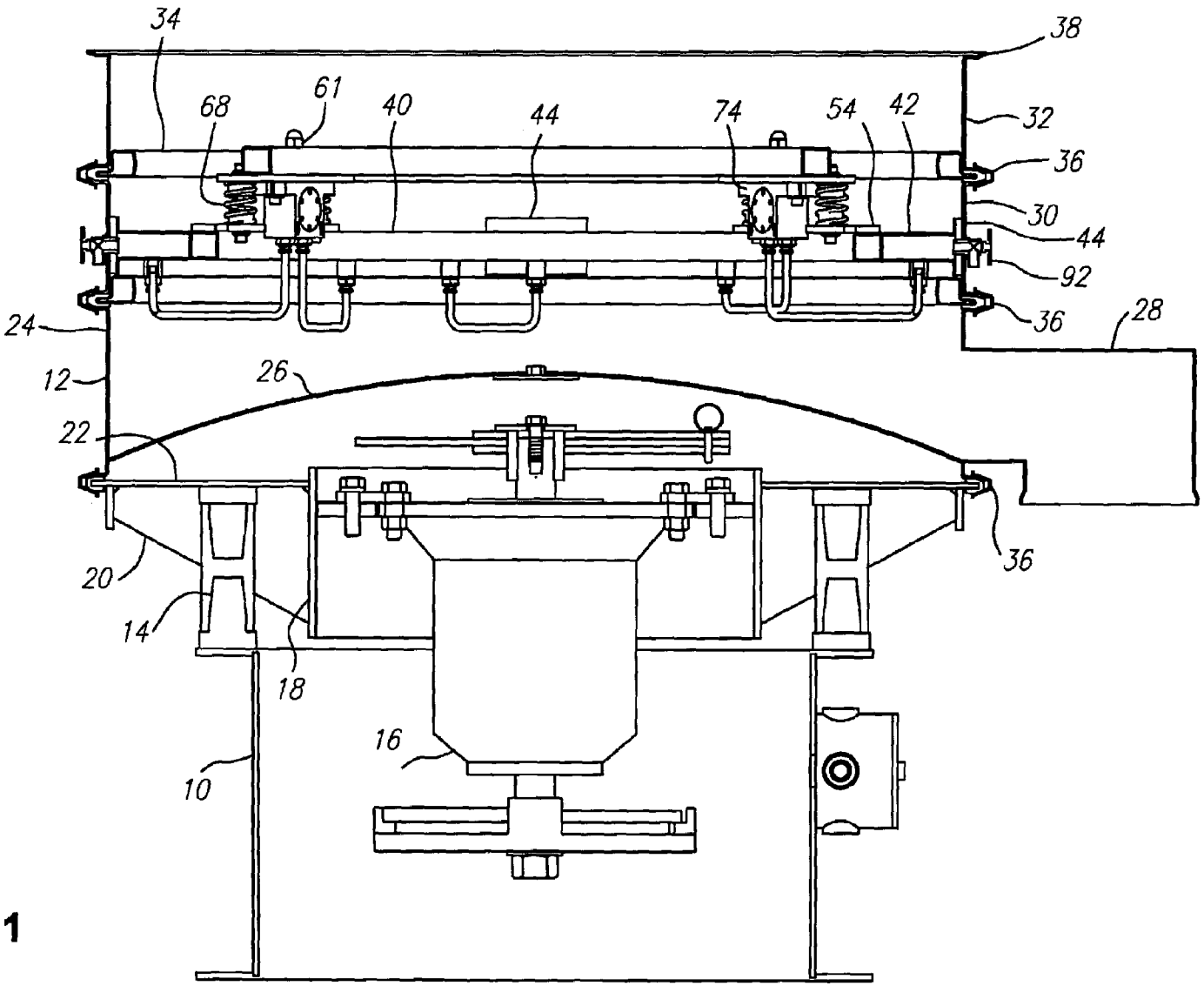
FIG. 1 is a schematic cross section of a vibratory screen separator.
Figure 2:
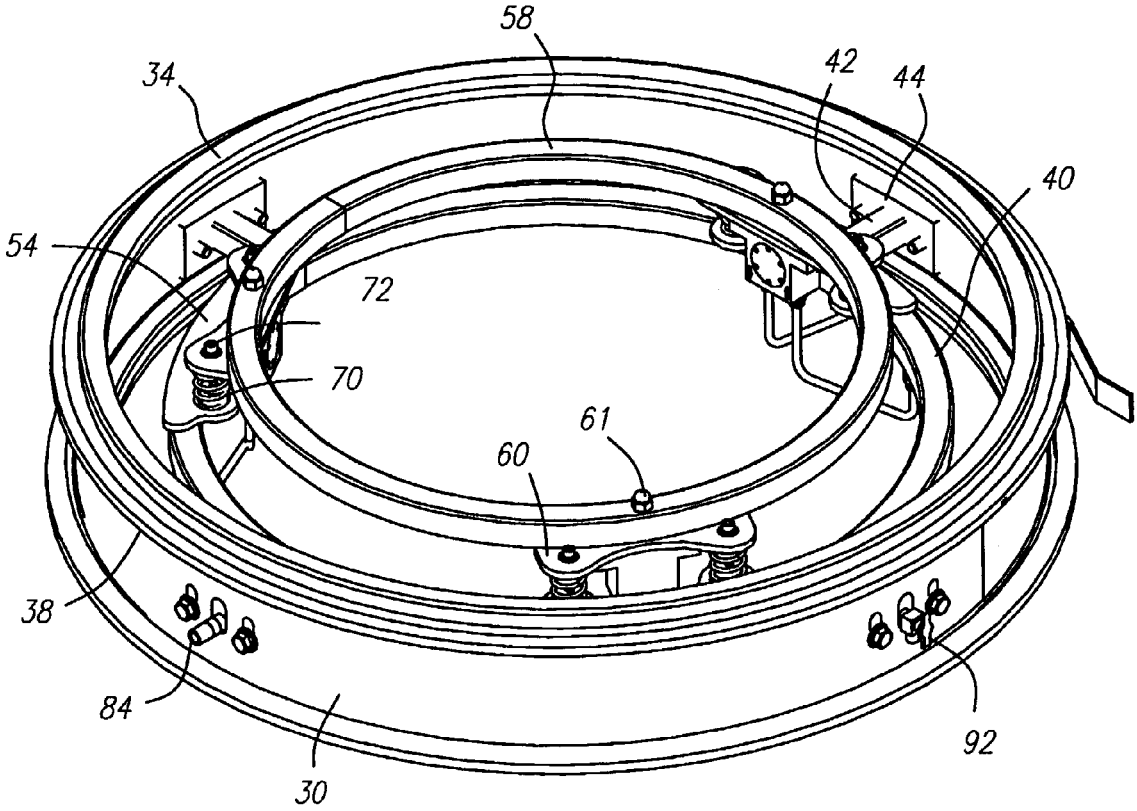
FIG. 2 is a perspective view of a vibrator assembly with the screen cloth removed for clarity.
Figure 3:
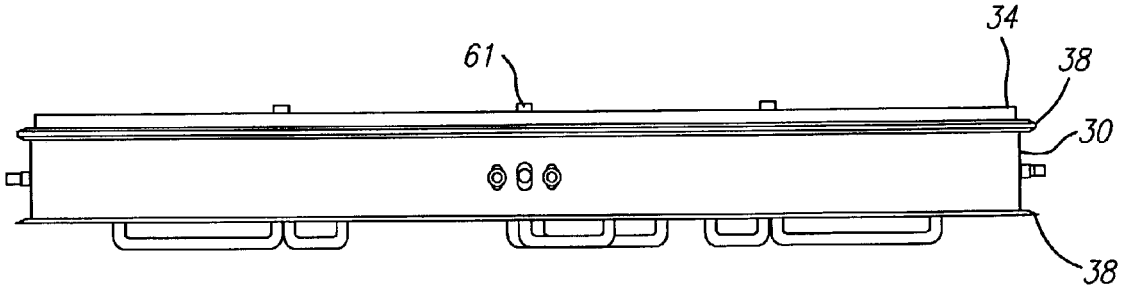
FIG. 3 is a side view of the vibrator assembly.
Figure 4:
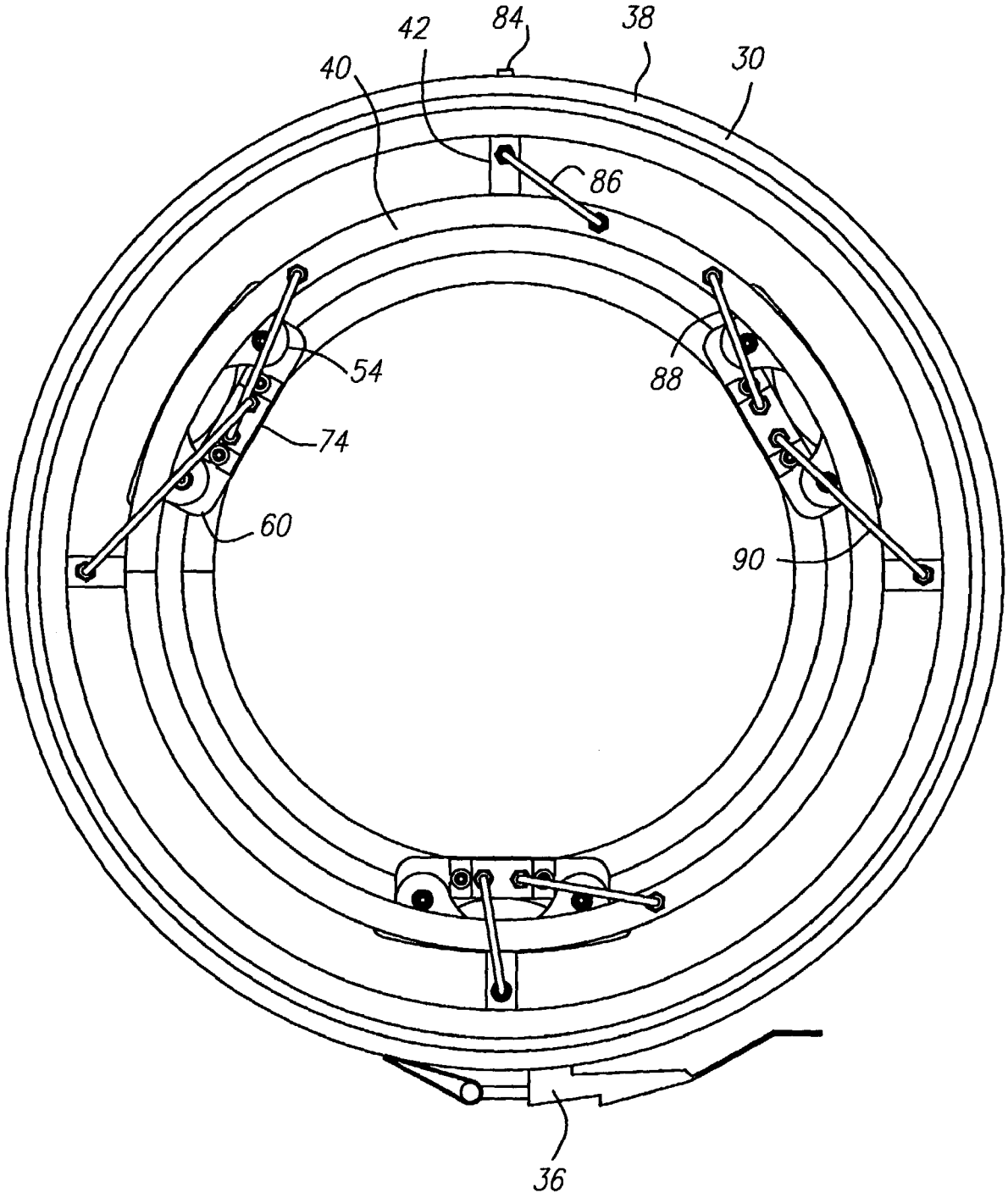
FIG. 4 is a bottom view of the vibrator assembly.
Figure 5:
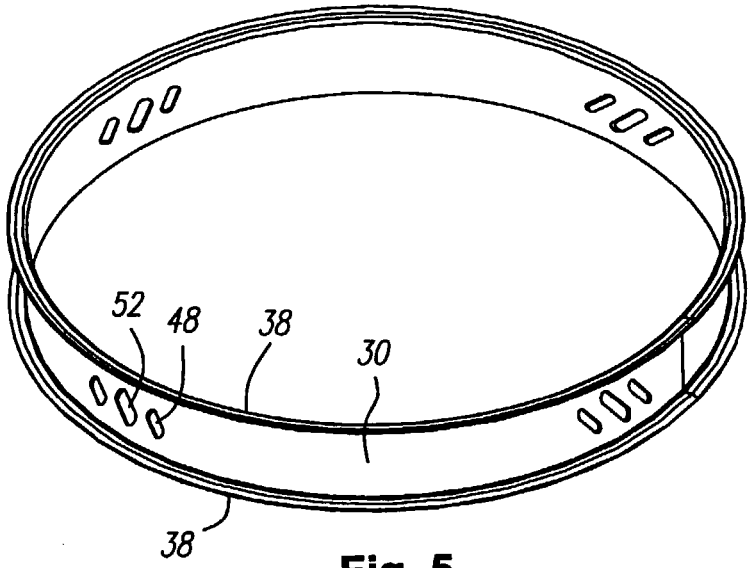
FIG. 5 is a perspective view of the housing section.
Figure 6:
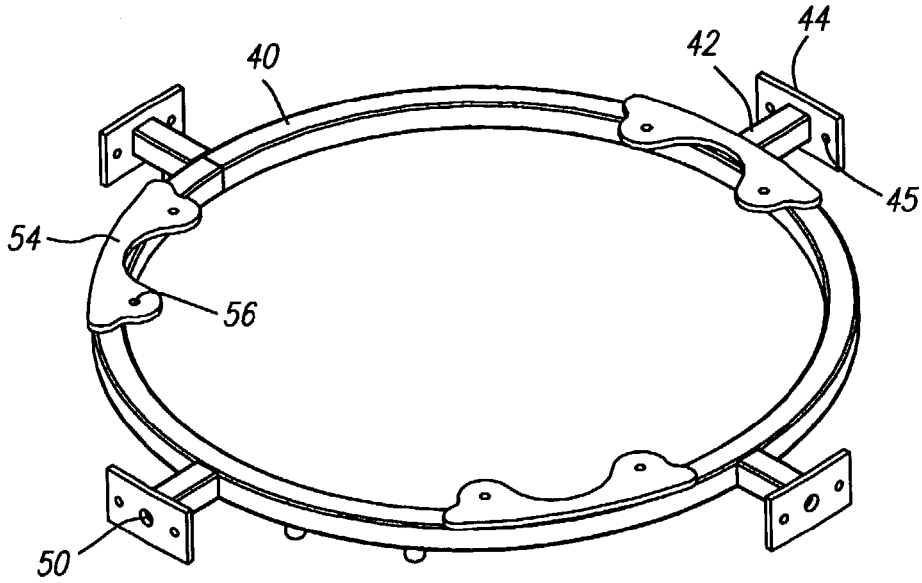
FIG. 6 is a perspective view of an inner portion of the frame.
Figure 7:
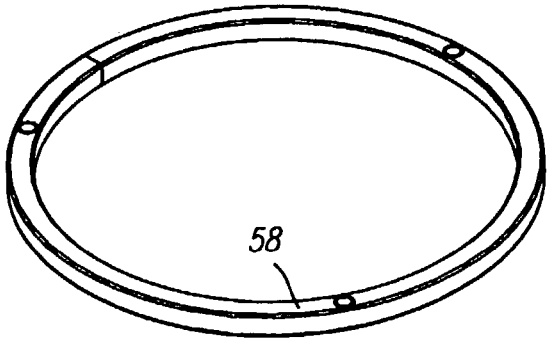
FIG. 7 is a perspective view of an energizer ring.
Figure 8:
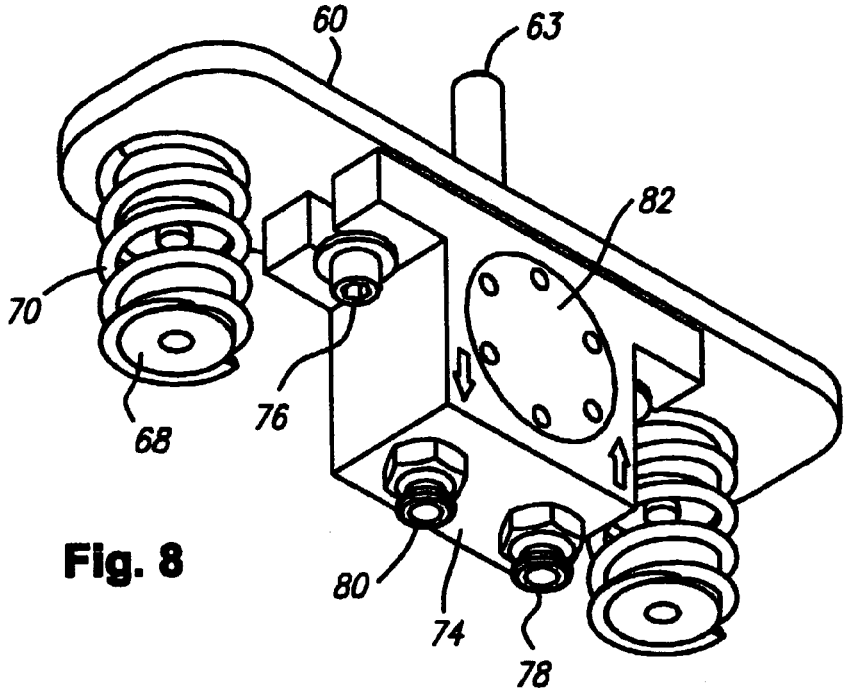
FIG. 8 is a perspective view of a turbine and turbine mounting.
Figure 9:
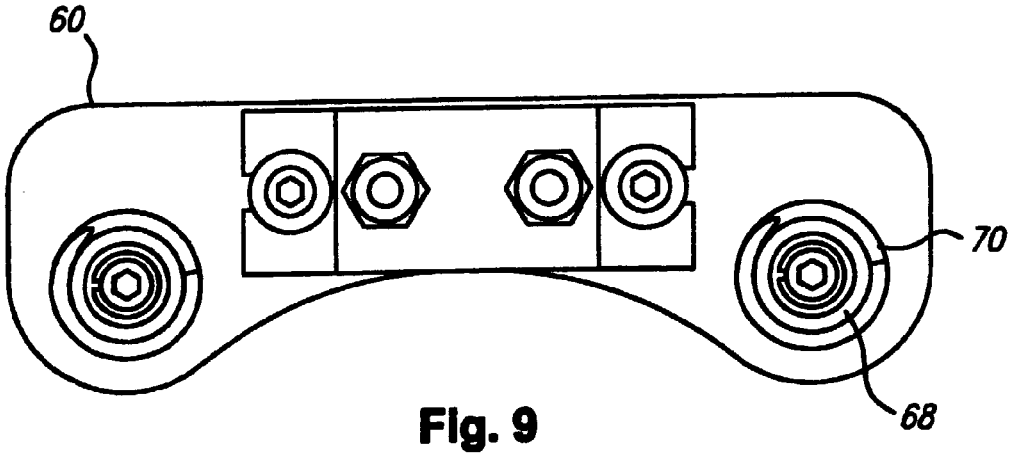
FIG. 9 is a bottom view of the turbine and turbine mounting.

Turning in detail to the Figures, FIG. 1 illustrates a screening system including a base 10, a cylindrical frame 12 resiliently mounted to the base 10 by springs 14. A low frequency vibratory drive 16 is coupled to vibrate the resiliently mounted frame 12. This vibratory drive is operable in a range of about 6 Hz to 30 Hz as a low frequency vibration and is mounted to the frame 12 by a housing 18 rigidly braced by gussets 20 in a bottom plate 22.

The frame includes a plurality of housing sections including a discharge housing section 24 mounted to the bottom plate 22. The discharge housing section 24 includes a distribution dome 26 and a discharge spout 28. A central housing section 30 includes the vibratory assembly. The upper housing section 32 provides a chamber above a taut screen 34 which is mounted atop the middle housing section 30.

The housing sections 24, 30 and 32 are held together by clamp bands 36 which retain annular flanges 38 on the several housing sections. The frame of the taut screen 34 includes a mounting flange which extends outwardly to between the annular flanges 38 of the housing section 30 and the upper housing section 32 with the assembly then clamped by the clamp band 36. A similar clamping mechanism is employed for the lower housing section 24 for association with the bottom plate 22. An upper spout (not shown) similar to the spout 28, associated with the upper housing section 32, discharges material not passing through the screen 34.

The resiliently mounted frame 12 of the vibratory assembly includes the housing section 30 which is cylindrical in this embodiment. Top and bottom annular flanges 38 extend about the housing section 30. The frame further includes a support ring 40 concentrically arranged within the housing section 30. Support elements 42 extend outwardly from the support ring 40 to the housing section 30. Mounting plates 44 are located at the outer ends of these support elements 42 to locate and mount the support ring 40. The mounting plates 44 have mounting holes 46 which cooperate with vertical slots 48 through the wall of the housing section 30. The slots 48 allow for some vertical adjustment of the support ring 40 for compression of the system against the taut screen 34. The support ring 40 and the support elements 42 are each hollow and conveniently rectangular in cross section. The mounting plates 44 include a central hole 50 for access to the hollow support elements 42. An access port 52 is associated with each pair of slots 48. Four access ports 52 align with the holes 50 in the four support elements 42. There is no interior communication between the hollow support ring 40 and the hollow support elements 42. The support ring 40 includes three mounting plates 54 with attachment holes 56. The plates 54 are securely fixed to the support ring 40.

A vibration transmitter assembly resiliently mounted to the support ring 40 includes a transmitter 58. The transmitter 58 is shown to be a circular planar ring of hollow tubing having a square cross section with radiused corners. This transmitter 58 is normally sized to divide the internal cross-sectional area of the housing section 30 into equal, concentric areas. This division provides substantially equal energy to both areas. However, particular circumstances associated with screening applications may advantageously employ transmitters 58 of varying diametric ratios with the housing 30. Also, multiple vibration transmitter assemblies may be used The taut screen 34 is bonded to the upper surface of the transmitter 58 in a first embodiment. Such bonding employs the same techniques as those conventionally employed for bonding the screen cloth to the screen frame of the taut screen 34.

Figure 10:
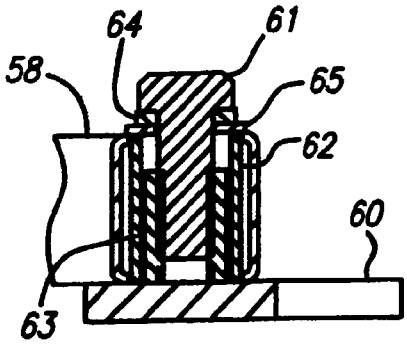
FIG. 10 is a cross-sectional detail of a first mounting embodiment for the turbine mounting.

To resiliently mount the vibration transmitter assembly including the transmitter 58, mounting plates 60 are affixed to the underside of the transmitter 58. The mounting plates 60 are secured to the transmitter 58 by fasteners 61 in the first embodiment illustrated in FIG. 10. In FIG. 10, mounting sleeves 62 receive the fasteners 61 which are fastened to the mounting plate 60 in the interior threads of mounting posts 63. Washers 64 spread the load of the head of the bolts 61 on the screen bonding material 65.

Figure 11:
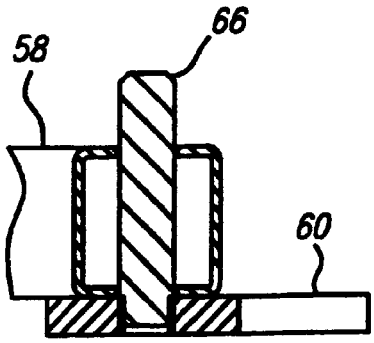
FIG. 11 is a cross-sectional detail of a second mounting embodiment for the turbine mounting.

In a second embodiment illustrated in FIG. 11, the mounting plate 60 is welded to threaded posts 66. The threaded posts 66 may be removably fit through holes in the transmitter 58 but preferably are fixed therein. Thus, the plates 60 are fixed in this way to the transmitter 58. Nuts (not shown) may work with the threaded posts 66 to fix the taut screen 34. In this second embodiment, the taut screen 34 is contemplated to include thin rings overlaying the transmitter 58 on either side of the screen cloth with holes therethrough to accept the posts 66. The thin rings (not shown) may be bonded together across the screen cloth of the taut screen 34.

On the other side of the mounting plates 60 from the mountings for the transmitter 58, resilient mounts 68 shown to include springs 70 are arranged at either end of each of the mounting plates 60. Fasteners 72 associated with the resilient mounts 68 of each of the mounting plates 60 cooperate with the attachment holes 56 in each of the mounting plates 54.

Also located on the underside of the mounting plates 60 with the resilient mounts 68 are air turbines 74. The air turbines 74 are each fastened to a respective mounting plate 60 by fasteners 76. The air turbines presently contemplated include an inlet port 78, an outlet port 80 and a turbine wheel (not shown) rotatably mounted within the turbine housing 82. The air turbines 74 operate as vibration generators because of eccentric weight associated with the turbine wheels. In the simple devices contemplated, the turbine wheels themselves have weighted turbine blades creating an imbalance resulting in vibration when the turbine is driven. Such devices operate in a range of about 275 Hz to 600 Hz.

The orientation of the air turbines 74 provides definition of the induced vibratory motion through the transmitter 58 to which they are rigidly coupled. To achieve substantially synchronous vertical vibration, the turbine wheels may be rotatably mounted about axes which extend through the symmetrical center axis of the transmitter 58 and rotate in the same direction as viewed from that center axis. To substantially the same effect, the turbine wheels may rotate about axes parallel to the local tangent of the transmitter ring 58 and rotate in the same direction relative to the local tangent of the transmitter ring 58. With the taut screen 34 being rigidly fixed within the housing 18, very little motion in the plane of the screen is experienced. More resilient screen mounting options would increase the amount of screen vibration in the plane of the screen. With the air turbines 74 mounted such that the axes of the turbine wheels extend normal to the screen, sifting action with movement of the screen in the plane of the screen is induced. Again, resilient mounting of the screen would provide for increased motion in this plane.

Pneumatic flow to drive the air turbines 74 advantageously employs the hollow support ring 40 and support elements 42 to define passages for fluid communication of the powering compressed air. A fitting 84 extends through one of the access ports 52 in the housing section 30 to be fitted into the associated hole 50 in the associated mounting plate 44. Interior to the housing section 30, an inlet tube 86 extends between the support element 42 associated with the fitting 84 to the support ring 40 for fluid communication between the hollow interiors of each. The support ring 40 then operates as a manifold to distribute compressed air about the frame to each of the air turbines 74. Fluid coupling is achieved between the interior of the support ring 40 and the inlet ports 78 of the air turbines 74 through distribution tubes 88. Exhaust tubes 90 extend from the air turbine to the remaining three support elements 42 through exhaust tubes 90. Air flow valves 92 are coupled with the remaining support elements 42 at the holes 50.

In operation, a screening system is assembled by including the housing section 30 within the stack of sections making up a vibratory separator housing 18. Multiple such housing sections 30 may be employed where multiple screens are used. The assembly of the support ring 40 and the support elements 42 is first fixed in place within the housing section 30. Height adjustments may be made to ultimately place a compression load from below against the taut screen 34. The mounting plates 60 are resiliently mounted to the support ring 40, most conveniently before the housing section 30 is assembled with the separator. The air turbines 74 are also appropriately assembled with the supporting structure along with the tubing 86, 88 and 90 and the associated fittings and valves.

With the upper housing section 32 yet to be assembled, the screen assembly, including the taut screen 34, is positioned atop the housing section 30. The frame of the taut screen is aligned with the periphery of the housing section 30. The transmitter 58, bonded to the taut screen 34, receives studs or bolts extending from the mounting plates 60. The upper housing section 32 is then positioned above the housing section 30 and clamped together therewith using a clamp band 36 which also captures the outwardly extending flange of the frame of the taut screen 34. As noted above, additional components may be added if a cover, additional screen layers or the like are contemplated. The air flow valves 92 are then adjusted to approximately the same air flow rate such that, when compressed air is supplied to the fitting 84, the air turbines 74 will be driven at substantially the same rotational speeds. With the air turbines 74 rotating and generating vibration, they will become synchronized unless a great disparity in the settings of the air flow valves 92 exist.

The screening system may then be set in motion and materials screened. The low frequency vibratory drive 16 typically operates in the range of about 8 Hz to 30 Hz. In this range, the entire resiliently mounted frame vibrates as a rigid body with the drive 16 generating a single cycle of amplitude in the frame at a time. Opening of the air flow valves 92 allows one or more of the air turbines 74 to be energized when a source of air is provided to the fitting 84. The air turbines 74 operate at around 275 Hz to 600 Hz in a subsonic range. The rigidity of the transmitter 58 causes it to respond as a rigid body such that the air turbines 74 also generate a single cycle of amplitude in the frame at a time. The taut screen 34, not being a rigid body at this range of vibration, experiences multiple cycles of amplitude at a time induced by the air turbines 74.

Thus, an improved screening system with a vibrator assembly to achieve complex vibrations in two separate ranges is disclosed. While embodiments and applications of this invention have been shown and described, it would be apparent to those skilled in the art that many more modifications are possible without departing from the inventive concepts herein. The invention, therefore is not to be restricted except in the spirit of the appended claims.

What is claimed is:

1. A screening system comprising a resiliently mounted frame;

a low frequency vibratory drive coupled to the frame to vibrate the frame;

a taut screen rigidly mounted in the frame;

a vibration transmitter assembly resiliently mounted to the frame and including a transmitter contacting the taut screen and at least one vibration generator fixed to the transmitter and operable in a subsonic frequency range to generate multiple cycles of amplitude in the taut screen at a time.

2. The screening system of claim 1,the low frequency vibratory drive operable in a range to generate substantially a single cycle of amplitude in the frame at a time.

3. The screening system of claim 2, the at least one vibration generator operable in the range of about 275 Hz to 600 Hz.

4. The screening system of claim 3, the low frequency vibratory drive operable in the range of about 8 Hz to 30 Hz.

5. The screening system of claim 1, the transmitter including a planer ring.

6. The screening system of claim 5, the planer ring being a circle.

7. The screening system of claim 5, the planer ring being rigid to vibrate with the at least one vibration generator as a rigid body.

8. The screening system of claim 1, the transmitter being attached to the screen.

9. The screening system of claim 1, the at least one vibration generator being rigidly fixed to the transmitter.

10. The screening system of claim 1, the at least one vibration generator having an air turbine with a rotatably mounted eccentric weight.

11. The screening system of claim 10 further comprising at least one air flow valve coupled with the air turbine of the at least one vibration generator.

12. The screening system of claim 11, the at least one vibration generator being a plurality of vibration generators and the at least one air flow valve being a plurality of air flow valves.

13. The screening system of claim 12, the plurality of air flow valves being coupled to the plurality of vibration generators, respectively.

14. The screening system of claim 1, the resiliently mounted frame including a housing section, a support ring substantially concentrically arranged within the housing section and support elements extending between the housing section and the support ring.

15. The screening system of claim 14, the support ring and the support elements having passages therethrough, there being fluid communication between one of the passages in the support elements and the passage in the support ring, there being fluid communication between the passage in the support ring and the at least one vibration generator and there being communication between the at least one vibration generator and another of the passages in the support elements.

16. The screening system of claim 15, the passages being partially defined by the support ring and the support elements being hollow.

17. The screening system of claim 16, there being fluid communication with the hollow support elements from outwardly of the housing section.

18. The screening system of claim 1, the transmitter being compressed against the taut screen.

19. A screening system comprising a resiliently mounted frame;

a low frequency vibratory drive coupled to the frame to vibrate the frame;

a taut screen rigidly mounted in the frame;

a vibration transmitter assembly resiliently mounted to the frame and including a transmitter contacting the taut screen to vibrate the taut screen and at least one vibration generator fixed to the transmitter, the transmitter vibrating with the at least one vibration generator as a rigid body.

20. The screening system of claim 19, the transmitter including a planer ring.

21. The screening system of claim 20, the planer ring being a circle.

22. The screening system of claim 19, the transmitter being attached to the screen.

23. The screening system of claim 19, the low frequency vibratory drive being operable in a range to generate substantially a single cycle of amplitude in the frame at a time, the at least one vibration generator operable in a subsonic frequency range to generate multiple cycles of amplitude in the taut screen at a time.

24. The screening system of claim 23, the at least one vibration generator operable in the range of 275 Hz to 600 Hz.

25. The screening system of claim 24, the low frequency vibratory drive operable in the range of 8 Hz to 30 Hz.

26. The screening system of claim 19, the at least one vibration generator being rigidly fixed to the transmitter.

27. The screening system of claim 19, the at least one vibration generator being air driven.

28. The screening system of claim 27 further comprising at least one air flow valve coupled with the air turbine of the at least one vibration generator.

29. The screening system of claim 28, the at least one vibration generator being a plurality of vibration generators and the at least one air flow valve being a plurality of air flow valves.

30. The screening system of claim 29, the plurality of air flow valves being coupled to the plurality of vibration generators, respectively.

31. The screening system of claim 19, the transmitter being compressed against the taut screen.

32. A screening system comprising a resiliently mounted frame;

a low frequency vibratory drive coupled to the frame to vibrate the frame;

a taut screen rigidly mounted in the frame;

a vibration transmitter contacting the taut screen to vibrate the taut screen and including at least one fluid driven vibration generator fixed to the transmitter.

33. The screening system of claim 32, the low frequency vibratory drive being operable in a range to generate substantially a single cycle of amplitude in the frame at a time, the at least one fluid driven vibration generator operable in a subsonic frequency range to generate multiple cycle of amplitude in the taut screen at a time.

34. The screening system of claim 33, the at least one fluid driven vibration generator operable in the range of 275 Hz to 600 Hz.

35. The screening system of claim 32, the at least one fluid driven vibration generator being air driven.

36. A screening system comprising a resiliently mounted frame;

a low frequency vibratory drive coupled to the frame to vibrate the frame;

a taut screen rigidly mounted in the frame;

a vibration transmitter assembly resiliently mounted to the frame and including a transmitter contacting the taut screen to vibrate the taut screen and at least one fluid driven vibration generator fixed to the transmitter.

37. The screening system of claim 36, the low frequency vibratory drive being operable in a range to generate substantially a single cycle of amplitude in the frame at a time, the at least one fluid driven vibration generator operable in a subsonic frequency range to generate multiple cycle of amplitude in the taut screen at a time.

38. The screening system of claim 37, the at least one fluid driven vibration generator operable in the range of 275 Hz to 600 Hz.

39. The screening system of claim 36, the at least one fluid driven vibration generator having an air turbine with a rotatably mounted eccentric weight.

40. The screening system of claim 39 further comprising at least one air flow valve coupled with the air turbine of the at least one fluid driven vibration generator.

41. The screening system of claim 40, the at least one fluid driven vibration generator being a plurality of fluid driven vibration generators and the at least one air flow valve being a plurality of air flow valves.

42. The screening system of claim 41, the plurality of air flow valves being coupled to the plurality of fluid driven vibration generators, respectively.

43. The screening system of claim 42, the plurality of air flow valves being coupled to the plurality of vibration generators, respectively.

44. The screening system of claim 36, the resiliently mounted frame including a housing section, a support ring substantially concentrically arranged within the housing section and support elements extending between the housing section and the support ring.

45. The screening system of claim 44, the support ring and the support elements being hollow, there being fluid communication between one of the hollow support elements and the hollow support ring, there being fluid communication between the hollow support ring and the at least one vibration generator and there being communication between the at least one vibration generator and the at least one other hollow support elements, respectively.

46. The screening system of claim 45, there being fluid communication with the hollow support elements from outwardly of the housing section.

47. A screening system comprising a resiliently mounted frame;

a low frequency vibratory drive coupled to the frame to vibrate the frame, the low frequency vibratory drive being operable in a range to generate substantially a single cycle of amplitude in the frame at a time;

a taut screen rigidly mounted in the frame;

a vibration transmitter assembly resiliently mounted to the frame and including a transmitter contacting the taut screen and at least one vibration generator fixed to the transmitter operable in a subsonic frequency range to generate multiple cycles of amplitude in the taut screen at a time, the transmitter being rigid to vibrate with the at least one vibration generator as a rigid body.

48. The screening system of claim 47, the at least one vibration generator operable in the range of 275 Hz to 600 Hz.

49. The screening system of claim 48, the low frequency vibratory drive operable in the range of 8 Hz to 30 Hz.

50. The screening system of claim 47, the transmitter including a planer ring.

51. The screening system of claim 50, the planer ring being a circle.

52. The screening system of claim 47, the transmitter being compressed against the taut screen.

53. The screening system of claim 47, the transmitter being attached to the taut screen.

54. A vibrator assembly for a screen, comprising a housing section including a mounting for the screen;

a support ring substantially concentrically arranged within the housing section;

support elements extending between the housing section and the support ring;

a vibration transmitter assembly resiliently mounted to the support ring and including a transmitter contacting the screen in the mounting to vibrate the screen and at least one vibration generator fixed to the transmitter and operable in the range of 275 Hz to 600 Hz, the transmitter vibrating with the at least one vibration generator as a rigid body.

55. The vibrator assembly of claim 54, the transmitter including a planer ring.

56. The vibrator assembly of claim 55, the planer ring being attached to the screen.

57. The vibrator assembly of claim 54, the at least one vibration generator being air driven.

58. The vibrator assembly of claim 57 further comprising at least one air flow valve coupled with the air turbine of the at least one vibration generator.

59. The vibrator assembly of claim 58, the at least one vibration generator being a plurality of vibration generators and the at least one air flow valve being a plurality of air flow valves.

60. The vibrator assembly of claim 59, the plurality of air flow valves being coupled to the plurality of vibration generators, respectively.

61. The vibrator assembly of claim 54, the support ring and the support elements being hollow, there being fluid communication between one of the hollow support elements and the hollow support ring, there being fluid communication between the hollow support ring and the at least one vibration generator and there being communication between the at least one vibration generator and the at least one other hollow support elements, respectively.

62. The vibrator assembly of claim 61 there being fluid communication with the hollow support elements from outwardly of the housing section.

* * * * *